US007723401B2

(12) United States Patent
Wang et al.

(10) Patent No.: US 7,723,401 B2
(45) Date of Patent: May 25, 2010

(54) PROCESS FOR PREPARING EROSION RESISTANT FOUNDRY SHAPES WITH AN EPOXY-ACRYLATE COLD-BOX BINDER

(75) Inventors: Xianping Wang, Dublin, OH (US); H. Randall Shriver, Columbus, OH (US); Jorg Kroker, Powell, OH (US)

(73) Assignee: Ashland Licensing and Intellectual Property, LLC, Dublin, OH (US)

( * ) Notice: Subject to any disclaimer, the term of this patent is extended or adjusted under 35 U.S.C. 154(b) by 12 days.

(21) Appl. No.: 11/825,176

(22) Filed: Jul. 5, 2007

(65) Prior Publication Data

US 2008/0099179 A1 May 1, 2008

Related U.S. Application Data

(60) Provisional application No. 60/818,861, filed on Jul. 6, 2006.

(51) Int. Cl.
*B22C 3/00* (2006.01)
*B22C 1/22* (2006.01)
*C08K 5/54* (2006.01)

(52) U.S. Cl. ..... 523/139; 164/16; 164/138; 524/730; 524/731

(58) Field of Classification Search ..... 523/139, 523/147, 145, 109, 144; 524/270, 272, 284, 524/612, 730, 731; 164/75, 16, 138; 528/405; 264/83; 106/38.2, 287.2
See application file for complete search history.

(56) References Cited

U.S. PATENT DOCUMENTS

| | | | | |
|---|---|---|---|---|
| 6,604,567 | B1 | 8/2003 | Woodson | |
| 6,662,854 | B2 * | 12/2003 | Woodson et al. | 164/138 |
| 6,684,936 | B2 | 2/2004 | Woodson | |
| 7,122,583 | B2 * | 10/2006 | Kroker et al. | 523/147 |
| 7,129,283 | B2 * | 10/2006 | Wang et al. | 523/139 |
| 7,407,543 | B2 * | 8/2008 | Stancliffe et al. | 106/38.2 |
| 7,407,994 | B2 * | 8/2008 | Kroker et al. | 523/147 |

FOREIGN PATENT DOCUMENTS

| | | | |
|---|---|---|---|
| WO | WO 03/068850 | * | 8/2003 |
| WO | WO 03/086682 | * | 10/2003 |

OTHER PUBLICATIONS

XFLPCHEM, A-187 product brochure, CAS No. 2530-83-8, 1999.*

* cited by examiner

*Primary Examiner*—Vasu Jagannathan
*Assistant Examiner*—Hannah Pak
(74) *Attorney, Agent, or Firm*—David L. Hedden

(57) ABSTRACT

This invention relates to a process for making foundry shapes (e.g. cores and molds) using epoxy-acrylate cold-box binders containing an oxidizing agent and elevated levels of an organofunctional silane, which are cured in the presence of sulfur dioxide, and to a process for casting metals using the foundry shapes. The metal parts have fewer casting defects because the foundry shapes made with the binder are more resistant to erosion.

9 Claims, 2 Drawing Sheets

PROCESS FOR PREPARING EROSION RESISTANT FOUNDRY SHAPES WITH AN EPOXY-ACRYLATE COLD-BOX BINDER

CLAIM TO PRIORITY

This application claims the benefit of U.S. Provisional Application No. 60/818,861 filed on Jul. 6, 2006, the contents of which are hereby incorporated into this application.

TECHNICAL FIELD

This invention relates to a process for making foundry shapes (e.g. cores and molds) using epoxy-acrylate cold-box binders containing an oxidizing agent and elevated levels of an organofunctional silane, which are cured in the presence of sulfur dioxide, and to a process for casting metals using the foundry shapes. The metal parts have fewer casting defects because the foundry shapes made with the binder are more resistant to erosion.

BACKGROUND

A foundry process widely used for making cores and molds entails the sulfur dioxide ($SO_2$) cured epoxy-acrylate binder system. In this process, a mixture of a hydroperoxide (usually cumene hydroperoxide), an epoxy resin, a multifunctional acrylate, a silane coupling agent, and optional diluents, are mixed with an aggregate (typically sand) and compacted into a pattern to give it a specific shape. The confined mixture is contacted with $SO_2$ vapor, optionally diluted with nitrogen, by blowing the $SO_2$ into the pattern where the shape is contained. There, the $SO_2$ reacts with the hydroperoxide to form an acid and free radicals. The generated acid cures the epoxy resin and the generated free radicals cure the multifunctional acrylate. The mixture is instantaneously hardened to result in the desired shape and can be used immediately in a foundry core and/or mold assembly.

The epoxy-acrylate binders used in this process are currently sold by Ashland Specialty Chemical under the trade name of ISOSET® and ISOSET THERMOSHIELD™ binders. Though the process has been used successful in many foundries, one of the major weaknesses of the epoxy-acrylate binder system has been the lack of adequate erosion resistance. Erosion occurs when molten metal contacts the mold or core surfaces during the pouring process and sand is dislodged at the point of contact. This occurs because the binder does not have sufficient heat resilience to maintain surface integrity until the pouring process is complete. The result is that loose sand is carried into the mold cavity by the liquid metal, creating sand inclusions and weak areas in the casting. A dimensional defect is also created on the surface of the casting.

To correct this problem, foundries have historically resorted to the use of refractory coatings. Core and mold assemblies or parts thereof are dipped into, flowed or sprayed with a slurry consisting of a high melting refractory oxide, a carrier such as water or alcohol, and thixotropic additives. When dried on a mold or core surface, the coating very effectively prevents erosion, in most cases. The problem with this approach is that the coating operation is messy, adds complexity to the sand casting process, and requires expensive gas fired, microwave, or radiant energy ovens to dry the wash onto the core surface. When the core and/or molds are heated during the drying process, the strength of the organic binder-to-aggregate bond weakens significantly. This results in problems handling the hot cores and reduction in productivity due to distortion or cracking of the core or mold.

All citations referred to under this description of the "Background" and in the "Detailed Description" of the invention are expressly incorporated by reference.

SUMMARY

Figure 1:
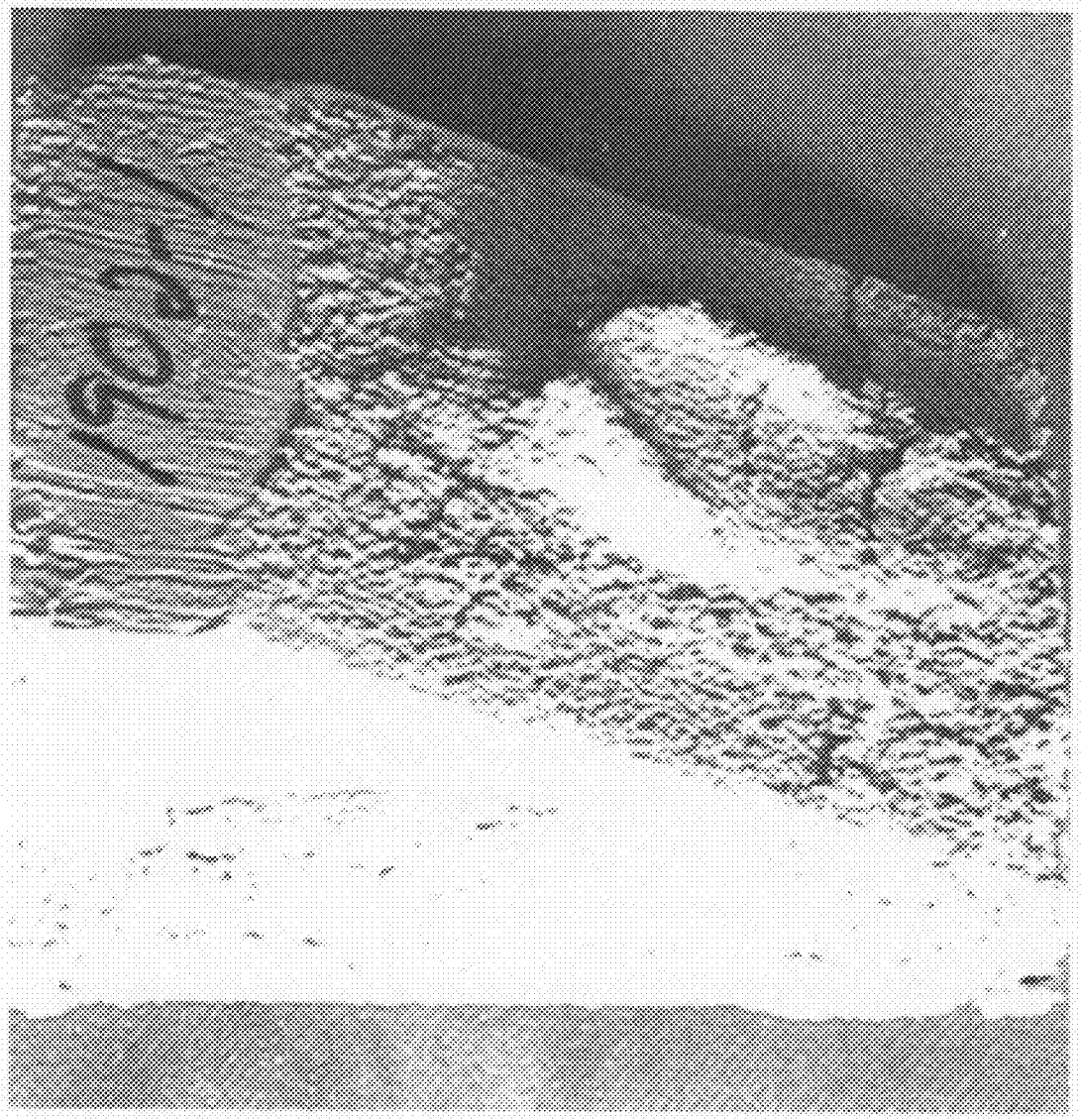
FIG. 1 is a representative photograph of an erosion wedge test casting that has an erosion rating of 4.5 and it shows that the core was severely eroded during the casting process.

This invention relates to a process for making foundry shapes (e.g. cores and molds) using epoxy-acrylate cold-box binders containing an oxidizing agent and increased levels of an organofunctional silane, which are cured in the presence of sulfur dioxide, and to a process for casting metals using the foundry shapes. The metal parts have fewer casting defects because the foundry shapes made with the binder as described herein are more resistant to erosion.

It has been found that using elevated levels of organofunctional silane in the $SO_2$ cured epoxy-acrylic binder system, results in cores or molds with enhanced hot strength properties as measured by erosion resistance. Thus, addition of organofunctional silanes at a level of at least 3 percent, based on weight of the binder, to a foundry binder composition containing a hydroperoxide, epoxy resin, multifunctional acrylate, and cured with sulfur dioxide, shows significantly enhanced hot strength as measured by erosion resistance. Because the foundry shapes are less resistant to erosion, they can be used to cast metal articles without coating the foundry shapes.

DETAILED DESCRIPTION

The detailed description and examples will illustrate specific embodiments of the invention that will enable one skilled in the art to practice the invention, including the best mode. It is contemplated that many equivalent embodiments of the invention will be operable besides these specifically disclosed. All percentages are percentages by weight unless otherwise specified.

An epoxy resin is a resin having an epoxide group which is represented by the following structure:

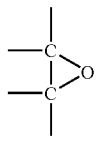

such that the epoxide functionality of the epoxy resin (epoxide groups per molecule) is equal to or greater than 1.9, typically from 2 to 4.0, and preferably from about 2.0 to about 3.7.

Examples of epoxy resins include (1) diglycidyl ethers of bisphenol A, B, F, G and H, (2) aliphatic, aliphatic-aromatic, cycloaliphatic and halogen-substituted aliphatic, aliphatic-aromatic, cycloaliphatic epoxides and diglycidyl ethers, (3)

epoxy novolacs, which are glycidyl ethers of phenol-aldehyde novolac resins, and (4) mixtures thereof.

Epoxy resins (1) are made by reacting epichlorohydrin with the bisphenol compound in the presence of an alkaline catalyst. By controlling the operating conditions and varying the ratio of epichlorohydrin to bisphenol compound, products of different molecular weight and structure can be made. Epoxy resins of the type described above based on various bisphenols are available from a wide variety of commercial sources.

Examples of epoxy resins (2) include glycidyl ethers of aliphatic and unsaturated polyols such as 3,4-epoxy cyclohexyl methyl-3,4-epoxy cyclohexane carboxylate, bis(3,4-epoxy cyclohexyl methyl)adipate, 1,2-epoxy-4-vinyl cyclohexane, 4-chloro-1,2-epoxy butane, 5-bromo-1,2-epoxy pentane, 6-chloro-1,3-epoxy hexane and the like Examples of epoxy novolacs (3) include epoxidized cresol and phenol novolac resins, which are produced by reacting a novolac resin (usually formed by the reaction of orthocresol or phenol and formaldehyde) with epichlorohydrin, 4-chloro-1,2-epoxybutane, 5-bromo-1,2-epoxy pentane, 6-chloro-1,3-epoxy hexane and the like. Particularly preferred are epoxy novolacs having an average equivalent weight per epoxy group of 165 to 200.

The acrylate is a reactive acrylic monomer, oligomer, polymer, or mixture thereof and contains ethylenically unsaturated bonds. Examples of such materials include a variety of monofunctional, difunctional, trifunctional, tetrafunctional and pentafunctional monomeric acrylates and methacrylates. A representative listing of these monomers includes alkyl acrylates, acrylated epoxy resins, cyanoalkyl acrylates, alkyl methacrylates and cyanoalkyl methacrylates. Other acrylates, which can be used, include trimethylolpropane triacrylate, pentaerythritol tetraacrylate, methacrylic acid and 2-ethylhexyl methacrylate. Typical reactive unsaturated acrylic polymers, which may also be used include epoxy acrylate reaction products, polyester/urethane/acrylate reaction products, acrylated urethane oligomers, polyether acrylates, polyester acrylates, and acrylated epoxy resins.

The free radical initiator is a peroxide, hydroperoxide, ketone peroxide, peroxy acid, or peroxy acid ester. Preferably, however, the free radical initiator is a hydroperoxide or a mixture of peroxide and hydroperoxide. Hydroperoxides particularly preferred in the invention include t-butyl hydroperoxide, cumene hydroperoxide, paramenthane hydroperoxide, etc.

Although the binder components can be added to the foundry aggregate separately, it is preferable to package the epoxy resin and free radical initiator as a Part I and add to the foundry aggregate first. Then the ethylenically unsaturated material, as the Part II, either alone or along with some of the epoxy resin, is added to the foundry aggregate.

Reactive diluents, such as mono- and bifunctional epoxy compounds, are not required in the binder composition, however, they may be used. Examples of reactive diluents include 2-butynediol diglycidyl ether, butanediol diglycidyl ether, cresyl glycidyl ether and butyl glycidyl ether.

Optionally, a solvent or solvents may be added to reduce system viscosity or impart other properties to the binder system such as humidity resistance. Typical solvents used are generally polar solvents, such as liquid dialkyl esters, e.g. dialkyl phthalates of the type disclosed in U.S. Pat. No. 3,905,934, and other dialkyl esters such as dimethyl glutarate, dimethyl succinate, dimethyl adipate, diisobutyl glutarate, diisobutyl succinate, diisobutyl adipate and mixtures thereof. Esters of fatty acids derived from natural oils, particularly rapeseed methyl ester and butyl tallate, are also useful solvents. Suitable aromatic solvents are benzene, toluene, xylene, ethylbenzene, alkylated biphenyls and naphthalenes, and mixtures thereof. Preferred aromatic solvents are mixed solvents that have an aromatic content of at least 90%. Suitable aliphatic solvents include kerosene, tetradecene, and mineral spirits.

If a solvent is used, sufficient solvent should be used so that the resulting viscosity of the epoxy resin component is less than 1,000 centipoise and preferably less than 400 centipoise. Generally, however, the total amount of solvent is used in an amount of 0 to 25 weight percent based upon the total weight of the epoxy resin contained in the binder.

The organofunctional silanes have the following structural formula:

$$Y—(CH_2)_n—Si(OR^a)_x(OR^b)_yR^c_z$$

wherein Y is selected from the group consisting of H; halogen; glycidyl groups; glycidyl ether groups; vinyl groups; vinyl ether groups; vinyl ester groups; allyl groups; allyl ether groups; allyl ester groups; acryl ester groups; isocyanate groups; alkyl groups, aryl groups, substituted alkyl groups, mixed alkyl-aryl groups, mercapto groups; amino groups, amino alkyl groups, amino aryl groups, amino groups having mixed alkyl-aryl groups, amino groups having substituted alkyl and aryl groups, amino carbonyl groups, ureido groups; alkyloxy silane groups; aryloxy silane groups and mixed alkyloxy aryloxy silane groups;

$R^a$, $R^b$ and $R^c$ are individually selected from the group consisting of alkyl groups, aryl groups, substituted alkyl groups, substituted aryl groups and mixed alkyl-aryl groups;

n is a whole number from 1 to 5, preferably 2 to 3;

x is a whole number from 0-3;

y is a whole number from 0-2;

z is 0 or 1, with x+y+z=3.

Examples of the organofunctional silanes include vinyl trimethoxy silane, amyl triethoxy silane, propyl trimethoxy silane, propyl triethoxy silane, propyl dimethoxy methyl silane, 3-aminopropyl triethoxy silane, 3-aminopropyl trimethoxy silane, 3-aminopropyl trimethyl diethoxy silane, 3-aminopropyl tris(methoxyethoxy ethoxy)silane, 3-(m-aminophenoxy)propyl trimethoxy silane, 3-(1,3-dimethyl butylidene)aminopropyl triethoxy silane, N-(2-amino ethyl)-3-aminopropyl trimethoxy silane, N-(2-aminoethyl)-3-aminopropyl triethoxy silane, N-(6-amino hexyl)-3-amino methyl trimethoxy silane, N-(2-amino ethyl)-11-aminoundecyl trimethoxy silane, (aminoethyl aminomethyl)phenethyl trimethoxy silane, N-3-[amino(polypropyleneoxy)]amino propyl trimethoxy silane, N-(2-amino ethyl)-3-aminopropyl methyl dimethoxy silane, N-(2-amino ethyl)-3-aminoisobutyl methyldimethoxy silane, (3-trimethoxy silyl propyl)diethylene triamine, n-butyl aminopropyl trimethoxysilane, N-ethyl aminoisobutyl trimethoxy silane, N-methyl aminopropyl trimethoxy silane, N-phenyl aminopropyl trimethoxy silane, 3-(N-allylamino)propyl trimethoxy silane, N-phenyl aminopropyl triethoxy silane, N-methyl aminopropyl methyl dimethoxy silane, bis(trimethoxysilyl propyl)amine, bis[(3-trimethoxy silyl)propyl]ethylene diamine, bis(triethoxy silyl propyl)amine, bis[3-(triethoxy silyl)propyl]urea, bis(methyldiethoxy silyl propyl)amine, N-(3-triethoxy silyl propyl)-4,5-dihydroimidazole, ureido propyl triethoxy silane, ureido propyl trimethoxy silane, 3-(triethoxy silyl)propyl succinic anhydride, 2-(3,4-epoxy cyclohexyl)ethyl triethoxy silane, 2-(3,4-epoxy cyclohexyl)ethyl trimethoxy silane, (3-glycidoxy propyl)trimethoxy silane, (3-glycidoxy propyl)triethoxy silane, 5,6-epoxy hexyl triethoxy silane, (3-glycidoxy propyl)methyl diethoxy silane, (3-glycidoxy propyl)methyl dimethoxy silane, 3-isocyanato propyl triethoxy silane, tris(3-trimethoxy silyl propyl)isocyanurate, triethoxy silyl propyl ethyl carbamate, 3-mercaptopropyl trimethoxy silane, 3-mercaptopropyl methyl dimethoxy silane, 3-mercaptopropyl trimethoxy silane, (3-glycidoxy propyl)bis (trimethyl siloxy)methyl silane, chloropropyl trimethoxy silane, methacryloxy propyl trimethoxy silane, N-cyclohexyl aminomethyl methyldiethoxy silane, N-cyclohexyl aminomethyl triethoxy silane, N-phenyl aminomethyl trimethoxy silane, (methacryloxy methyl)methyldimethoxysilane, methacryloxymethyltrimethoxysilane, (methacryloxymethyl)methyldiethoxysilane, methacryloxymethyltriethoxysilane, (isocyanatomethyl)methyl dimethoxy silane, N-trimethoxy silyl methyl-O-methyl carbamate, N-dimethoxy(methyl) silyl methyl-O-methyl carbamate, N-cylcohexyl-3-aminopropyl trimethoxysilane, 3-methacryloxypropyl triacetoxy silane, 3-isocyanatopropyl trimethoxy silane, isooctyl trimethoxy silane, isooctyl triethoxy silane, 3-methacryloxypropyl methyl dimethoxy silane, 3-methacryloxy propyl methyl diethoxy silane, 3-methacryloxy propyltriethoxy silane, 3-acryloxy propyl trimethoxy silane, and bis(triethoxy silyl propyl)tetrasulfide.

Preferred organofunctional silanes are propyl trimethoxy silane, 2-(3,4-epoxy cyclohexyl)ethyl triethoxy silane, 2-(3,4-epoxy cyclohexyl)ethyl trimethoxy silane, (3-glycidoxy propyl)trimethoxy silane, (3-glycidoxy propyl)triethoxy silane, 5,6-epoxy hexyl triethoxy silane, (3-glycidoxypropyl)methyl diethoxy silane, (3-glycidoxypropyl)methyl dimethoxy silane, (3-glycidoxy propyl)bis (trimethyl siloxy)methyl silane, methacryloxy propyl trimethoxy silane, (methacryloxy methyl)methyl dimethoxy silane, methacryloxy methyl trimethoxy silane, (methacryloxy methyl)methyl diethoxy silane, methacryloxy methyl triethoxy silane, Isooctyl trimethoxy silane, isooctyl triethoxy silane, 3-methacryloxy propyl methyl dimethoxy silane, 3-methacryloxy propyl methyl diethoxy silane, 3-methacryloxy propyl triethoxy silane, 3-acryloxy propyl trimethoxy silane, and vinyl trimethoxy silane.

The most preferred organofunctional silanes are (3-glycidoxy propyl)trimethoxy silane, methacryloxy propyl trimethoxy silane and vinyl trimethoxy silane.

The organofunctional silane is used at elevated amounts, at least 3.0 parts by weight, preferably from 4.0 parts by weight to 6.0 parts by weight, based upon 100 parts by weight of the total binder system.

Phenolic resins may also be used in the foundry binder. Examples include any phenolic resin, which is soluble in the epoxy resin and/or acrylate, including metal ion and base catalyzed phenolic resole and novolac resins as well as acid catalyzed condensates from phenol and aldehyde compounds. However, if phenolic resole resins are used in the binder, typically used are phenolic resole resins known as benzylic ether phenolic resole resins, including alkoxy-modified benzylic ether phenolic resole resins. Benzylic ether phenolic resole resins, or alkoxylated versions thereof, are well known in the art, and are specifically described in U.S. Pat. Nos. 3,485,797 and 4,546,124, which are hereby incorporated by reference. These resins contain a preponderance of bridges joining the phenolic nuclei of the polymer, which are ortho-ortho benzylic ether bridges, and are prepared by reacting an aldehyde with a phenol compound in a molar ratio of aldehyde to phenol of at least 1:1 in the presence of a divalent metal catalyst, preferably comprising a divalent metal ion such as zinc, lead, manganese, copper, tin, magnesium, cobalt, calcium, and barium.

It will be apparent to those skilled in the art that other additives such as silicones, release agents, defoamers, wetting agents, etc. can be added to the aggregate, or foundry mix. The particular additives chosen will depend upon the specific purposes of the formulator.

Various types of aggregate and amounts of binder are used to prepare foundry mixes by methods well known in the art. Ordinary shapes, shapes for precision casting, and refractory shapes can be prepared by using the binder systems and proper aggregate. The amount of binder and the type of aggregate used are known to those skilled in the art. The preferred aggregate employed for preparing foundry mixes is sand wherein at least about 70 weight percent, and preferably at least about 85 weight percent, of the sand is silica. Other suitable aggregate materials for producing foundry shapes include zircon, olivine, chromite sands, and the like, as well as man-made aggregates including aluminosilicate beads and hollow microspheres and ceramic beads, e.g. Cerabeads.

In ordinary sand casting foundry applications, the amount of binder is generally no greater than about 10% by weight and frequently within the range of about 0.5% to about 7% by weight based upon the weight of the aggregate. Most often, the binder content for ordinary sand foundry shapes ranges from about 0.6% to about 5% by weight based upon the weight of the aggregate.

The foundry mix is molded into the desired shape by ramming, blowing, or other known foundry core and mold making methods. The shape confined foundry mix is subsequently exposed to effective catalytic amounts of sulfur dioxide vapor, which results in almost instantaneous cure of the binder yielding the desired shaped article. The exposure time of the sand mix to the gas is typically from 0.5 to 10 seconds. Optionally, a blend of nitrogen, as a carrier gas, and sulfur dioxide containing from 35 percent by weight or more of sulfur dioxide may be used, as described in U.S. Pat. Nos. 4,526,219 and 4,518,723, which are hereby incorporated by reference.

The core and/or mold may be incorporated into a mold assembly. When making castings, typically individual parts or the complete assembly is coated with a solvent or water-based refractory coating and in case of the latter passed through a conventional or microwave oven to remove the water from the coating. Molten metal is poured into and around the mold assembly while in the liquid state where it cools and solidifies to form a metal article. After cooling and solidification, the metal article is removed from the mold assembly and, if sand cores were used to create cavities and passages in the casting, the sand is shaken out of the metal article, followed by cleaning and machining if necessary. Metal articles can be made from ferrous and non-ferrous metals.

Abbreviations:

The following abbreviations are used in the Examples.

| | |
|---|---|
| S-1 | γ-glycidoxypropyl trimethoxy silane (e.g. SILQUEST ® A-187 from GE Silicones) |
| S-2 | vinyl trimethoxy silane (e.g. SILQUEST A-171 from GE Silicones) |
| S-3 | γ-isocyanatopropyl triethoxy silane (e.g. SILQUEST A-1310 from GE Silicones) |
| S-4 | octyl triethoxy silane (e.g. SILQUEST A-137 from GE Silicones) |
| S-5 | γ-acryloxypropyl trimethoxy silane (e.g. KBM-5103 silane from Shinetsu) |
| Bis-A Epoxy | bisphenol-A epoxy resin, 1.9 functionality, EEW 184-192, viscosity 13,000 cPs @ 25° C. (e.g DER ® 331 from Dow) |
| Bis-F | epoxy bisphenol-F epoxy resin, 2.0 functionality, EEW 165-170, viscosity 3,500 cPs @ 25° C. (e.g DER 354 from Dow) |
| EPN | epoxy novolac resin, 3.6 functionality, EEW 171-183, viscosity 20,000-30,000 cPs @ 52° C. (e.g. EPALLOY ® 8330 from CVC Specialty Chemicals) |
| CHP | cumene hydroperoxide (e.g. GEO Specialty Chemicals) |
| TMPTA | trimethylolpropane triacrylate (e.g. Cytec Surface Specialties, Inc.) |
| HDODA | 1,6-hexanediol diacrylate (e.g. Sartomer Company) |
| aliphatic solvent | kerosene (e.g. KERO ® 1-K from Esso Chemical) |
| SCA | silane coupling agent (e.g. SILQUEST A-187 from GE Silicones) |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application, all units are in the metric system and all amounts and percentages are by weight, unless otherwise expressly indicated.

Measurement of Erosion Resistance

Erosion wedge test cores were made with the formulations given in the following Examples and evaluated for erosion resistance.

The shape of the erosion wedge and a diagram of the test method are shown in FIG. 7 of "Test Casting Evaluation of Chemical Binder Systems", W L Tordoff et al, AFS Transactions, 80-74, (pages 152-153), developed by the British Steel Casting Research Association, which is hereby incorporated by reference. According to this test, molten iron is poured through a pouring cup into a 1-inch diameter by 16-inch height sprue, impinges upon the sand surface at an angle of 60°, to fill a wedge-shaped cavity.

When the mold cavity is filled, pouring is stopped and the specimen is allowed to cool. When cool, the erosion wedge test casting is removed and the erosion rating determined. If erosion has occurred, it shows up as a protrusion on the slant side of the test wedge.

Resistance to erosion was evaluated based on the results of the tests and the uncoated cores made with the binders. The severity of the erosion is indicated by assigning a numerical rating: 1=Excellent, 2=Good, 3=Fair, 4=Poor, 5=Very poor. This is a very severe erosion test. A rating of 1 or 2 generally implies excellent erosion resistance in actual foundry practice, if the same aggregate, binder type and application levels are used. A rating of 3 or higher indicates that a coating is needed. In some tests where erosion is particularly severe, a rating of 5+ may be given, indicating off-scale erosion.

Examples

A commercially available $SO_2$ cured 2-part epoxy-acrylate cold box binder was used to make the erosion wedge test cores, namely ISOSET THERMOSHIELD™ 4480/4491 available from Ashland Specialty Chemical.

Part I (ISOSET THERMOSHIELD 4480) of the binder comprises:

| | |
|---|---|
| Bis-F Epoxy | 45-55% |
| EPN | 10-20% |
| CHP | 23-41% |

Part II (ISOSET THERMOSHIELD 4491) of the binder comprises:

| | |
|---|---|
| Bis-A Epoxy | 15-30% |
| Bis-F Epoxy | 15-30% |
| TMPTA | 40-55% |
| HDODA | 1-10% |
| Aliphatic solvent | 1-10% |
| SCA | <1% |

The binder was applied at a level of 1 percent, based on the weight of the sand, at a Part I to Part II weight ratio of 60:40.

Comparison Example A (No Elevated Level of Organofunctional Silane.)

Erosion wedge test cores were prepared by mixing 3000 grams of silica sand to which 18 grams of Part I and 12 grams of Part II were added. The components were mixed for 1 minute using a high speed Delonghi sand mixer. The sand/resin mixture was then blown at 60 psi for one second into a metal pattern, gassed with sulfur dioxide for 2 seconds and purged with air for 12 seconds to cure the mix, which resulted in a test core weighing approximately 1240 grams.

The finished test core was removed from the metal pattern and inserted into the erosion wedge test assembly. Molten gray iron (GI 30) at 2600° F. was poured into the constant head pouring cup to flow down the sprue, impinge on the slant surface of the test core and fill the wedge shaped mold cavity. When the mold cavity was full, pouring was stopped and the casting was allowed to cool. When cool, the erosion test wedge casting was removed and the erosion rating determined.

The above binder resulted in an erosion rating of 4.5 (poor). FIG. 1 is a representative example of an erosion wedge test casting having an erosion rating of 4.5.

Example 1

Elevated Level of Organofunctional Silane, 5% S-1, Based on the Combined Weight of Part I and Part II Comparison Example A was prepared, except additional organofunctional silane was added to the sand mix as a third part to result in elevated levels of organofunctional silane in the binder-sand mixture.

Figure 2:
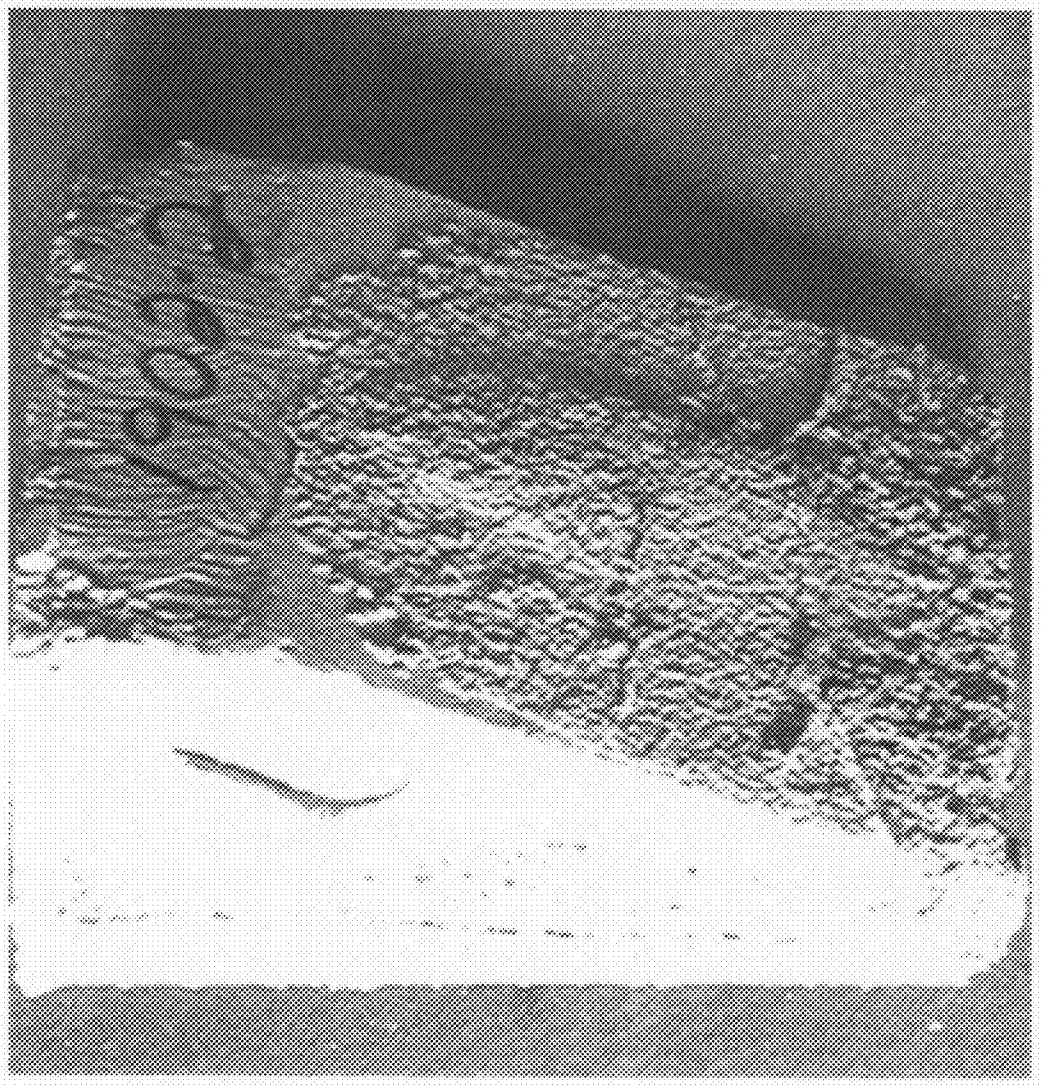
FIG. 2 is a representative photograph of an erosion wedge test casting that has an erosion rating of 2.5 and it shows that the core was not severely eroded during the casting process.

Test cores were prepared by mixing 3000 grams of silica sand to which 18 grams of Part I and 12 grams of Part II were added. Then 1.5 grams of organofunctional silane S-1 were added and mixing was resumed. This binder resulted in an erosion rating of 2.5 (good). FIG. 2 is a representative example of an erosion wedge test casting having an erosion rating of 2.5.

Example 2

Elevated Level of Organofunctional Silane, 5% S-2, Based on the Combined Weight of Part I and Part II Example 1 was repeated, except organofunctional silane S-2 was used.

Test cores were prepared by mixing 3000 grams of silica sand to which 18 grams of Part I and 12 grams of Part II were added. Then 1.5 grams of organofunctional silane S-2 were added and mixing was resumed.

This binder resulted in an erosion rating of 2.0 (good).

Example 3

Elevated Level of Organofunctional Silane, 5% S-5, Based on the Combined Weight of Part I and Part II Example 1 was repeated, except organofunctional silane S-5 was used.

Test cores were prepared by mixing 3000 grams of silica sand to which 18 grams of Part I and 12 grams of Part II were added. Then 1.5 grams of organofunctional silane S-5 were added and mixing was resumed.

This binder resulted in an erosion rating of 2.5 (good).

Example 4

Elevated Level of Organofunctional Silane, 5% S-4, Based on the Combined Weight of Part I and Part II Example 1 was repeated, except organofunctional silane S-4 was used.

Test cores were prepared by mixing 3000 grams of silica sand to which 18 grams of Part I and 12 grams of Part II were added. Then 1.5 grams of organofunctional silane S-4 were added and mixing was resumed.

This binder resulted in an erosion rating of 2.5 (good).

Example 5

Elevated Level of Organofunctional Silane, 5% S-3, Based on the Combined Weight of Part I and Part II Example 1 was repeated, except organofunctional silane S-3 was used.

Test cores were prepared by mixing 3000 grams of silica sand to which 18 grams of Part I and 12 grams of Part II were added. Then 1.5 grams of organofunctional silane S-3 were added and mixing was resumed.

This binder resulted in an erosion rating of 2.5 (good).

The results of the Examples are summarized in Table I.

TABLE I (Effect of Using Elevated Levels of Organofunctional Silane in Epoxy-Acrylate Cold- Box Binder Systems on Erosion Resistance of Foundry Shapes Prepared with Binder)

| Example | Ratio of Part I to Part II | Amount of Organo-functional Silane (pbw based upon 100 parts of binder) | Erosion resistance of Test Core |
|---|---|---|---|
| A | 60:40 | <1.0 | 4.5 |
| 1 | 60:40 | 5.0 | 2.5 |
| 2 | 60:40 | 5.0 | 2.0 |
| 3 | 60:40 | 5.0 | 2.5 |
| 4 | 60:40 | 5.0 | 2.5 |

The data in Table I indicate that elevated levels of organofunctional silane resulted in an improvement in the erosion resistance of the test cores. The improvement is significant because it could permit the foundry to use the core or mold without a refractory coating, which reduces the complexity of the sand casting process and saves time and expense.

We claim:

1. A process for preparing a foundry shape comprising:

(a) introducing a foundry mix into a pattern to form a foundry shape; and (b) curing said shape with gaseous sulfur dioxide;

wherein said foundry mix comprises:

(c) from 90 to 99 parts by weight of a foundry aggregate; and a foundry binder comprising:

(d) 20 to 70 parts by weight of an epoxy resin;

(e) 5 to 50 parts by weight of an acrylate;

(f) 3 to 6 parts by weight of an organofunctional silane selected from the group consisting of γ-glycidoxypropyl trimethoxy silane, vinyl trimethoxy silane, γ-isocyanatopropyl triethoxy silane, octyl triethoxy silane, γ-acryloxypropyl trimethoxy silane, and mixtures thereof, (g) an effective amount of a peroxide, provided (d) is not mixed with (g), and where said parts by weight are based upon 100 parts of binder.

2. The process of claim 1 wherein the binder comprises from about 40 to 65 parts by weight of the epoxy resin; from 5 to 30 parts by weight of the acrylate; from 15 to 20 parts by weight of the free radical initiator; and from 4 to 6 parts by weight of the organofunctional silane, where said parts by weight are based upon 100 parts by binder.

3. The process of claim 2 wherein the wherein the epoxy resin comprises an epoxy resin derived from a bisphenol selected from the group consisting of bisphenol A, bisphenol F, and mixtures thereof.

4. The process of claim 3 wherein the epoxy resin has an epoxide equivalent weight of about 165 to about 225 grams per equivalent.

5. The process of claim 4 wherein the acrylate is a monomer.

6. The process of claim 5 wherein the acrylate is trimethyolpropane triacrylate, hexanediol diacrylate, and mixtures thereof.

7. A foundry shape prepared in accordance with claim 1, 2, 3, 4, 5, or 6.

8. A process of casting a metal article comprising:

(a) fabricating an uncoated foundry shape in accordance with claim 7;

(b) pouring said metal while in the liquid state into said foundry shape;

(c) allowing said metal to cool and solidify; and (d) then separating the cast article.

9. A metal casting produced in accordance with claim 8.

* * * * *

UNITED STATES PATENT AND TRADEMARK OFFICE

CERTIFICATE OF CORRECTION

PATENT NO. : 7,723,401 B2
APPLICATION NO. : 11/825176
DATED : May 25, 2010
INVENTOR(S) : Xianping Wang, H. Randall Shriver and Jorg Kroker It is certified that error appears in the above-identified patent and that said Letters Patent is hereby corrected as shown below:

At column 10, line 46 (claim 1), delete "(d)" and insert therefor --(e)--.

Signed and Sealed this

Second Day of November, 2010

David J. Kappos

David J. Kappos
*Director of the United States Patent and Trademark Office*